United States Patent [19]

Flewelling

[11] 4,046,034

[45] Sept. 6, 1977

[54] ADJUSTABLE WRENCH

[76] Inventor: Harry J. Flewelling, 4040 N. Stiles, Oklahoma City, Okla. 73105

[21] Appl. No.: 600,896

[22] Filed: Aug. 1, 1975

[51] Int. Cl.[2] ..... B25B 13/16

[52] U.S. Cl. ..... 81/165; 81/172

[58] Field of Search ..... 81/165, 172

[56] References Cited

U.S. PATENT DOCUMENTS

| | | | |
|---|---|---|---|
| 3,368,432 | 2/1968 | Halls | 81/165 |
| 3,541,899 | 11/1970 | Tanner | 81/172 X |
| 3,555,939 | 1/1971 | Halls | 81/172 X |
| 3,673,896 | 7/1972 | Vardaman | 81/165 |
| 3,901,107 | 8/1975 | Halls | 81/165 X |

*Primary Examiner*—Al Lawrence Smith
*Assistant Examiner*—James G. Smith
*Attorney, Agent, or Firm*—Robert M. Hessin

[57] ABSTRACT

Improvements in construction of an open end adjustable wrench of the type which utilizes a handle enclosed helix-actuating assembly and thumb slide actuator for opening and closing the jaws of the wrench, such improvements being directed to the handle cavity, helix actuator and bearing members in support thereof. More particularly, the actuator cavity is of such design and shape that it can be formed as by drop forging while unitarily forming base bearing members therein in properly spaced relationship for receiving the helix actuator in rotatable, longitudinally fixed position to extend a bevel gear into proper operational relationship with a mating bevel gear to drive the jaw adjusting worm gear within the head of the wrench. A cavity cover plate is then unitarily formed with properly positioned retaining bearings such that the cover plate is easily affixed over the cavity with retaining bearings in proper position to coact with the helix actuator.

3 Claims, 8 Drawing Figures

ADJUSTABLE WRENCH

BACKGROUND OF THE INVENTION

1. Field of the Invention

The invention relates generally to helix-actuated adjustable open end wrenches and, more particularly, but not by way of limitation, it relates to improved manufacture and construction of such wrenches to enable ready manufacture and improved operation.

2. Description of the Prior Art

The prior art includes numerous types of helix-actuated open end adjustable wrenches, some of which are quite old in the art. Some of the early approaches to such wrench construction may best be characterized by the U.S. Pat. No. 2,795,987 in the name of Schlote; but some other more recent U.S. Pats. relating to the similar type of wrench are U.S. Pat. No. 3,541,899 to Tanner, U.S. Pat. No. 3,555,939 to Halls, U.S. Pat. No. 3,640,159 to Halls et. al., and U.S. Pat. No. 3,673,896 in the name of Vardaman. While inspection of the cited prior art will show that the type of wrench in question has received wide attention and much industry of development, it becomes apparent that there are many inherent difficulties and problems to be overcome in manufacturing a helix-actuated open end adjustable wrench of proper design characteristics and operational reliability.

SUMMARY OF THE INVENTION

The present invention relates to improvement in construction of an open end, helix-actuated wrench, which improvements are largely directed to the mode of manufacture wherein the actuator cavity, support bearings and cavity cover plate are more easily formed by conventional machine measure, and the components are easily assembled into operational position and attitude with minimal dimensional variation and misalignment. The actuator cavity and base bearing members are unitarily formed in a single, simple drop forge operation whereupon the helix actuator and bevel drive gear can be received in the base support bearings and retained in proper axial alignment, and then the cover plate and unitarily formed retaining support bearings are affixed in overlay with positioning of the thumb slide acuating boss to complete the assembly.

Therefore, it is an object of the present invention to provide an open end adjustable wrench helix drive actuator assembly which can be easily inserted and/or removed for ready assembly and/or cleaning.

It is also an object of the present invention to provide an improved helix drive adjustable wrench wherein helix actuator elements are more readily interchangeable.

It is yet further an object of the present invention to provide a helix-actuated adjustable wrench wherein the handle cavity is formed by a simple drop forging operation without requirement of additional milling or internal cavity shaping in any form.

Finally, it is an object of the present invention to provide a helix-actuated wrench of a type which is less costly of manufacture, more easily maintained, and more reliable in operation.

Other objects and advantages of the invention will be evident from the following detailed description when read in conjunction with the accompanying drawings which illustrate the invention.

BRIEF DESRIPTION OF THE DRAWINGS

DETAILED DESCRIPTION OF THE INVENTION

Figure 1:
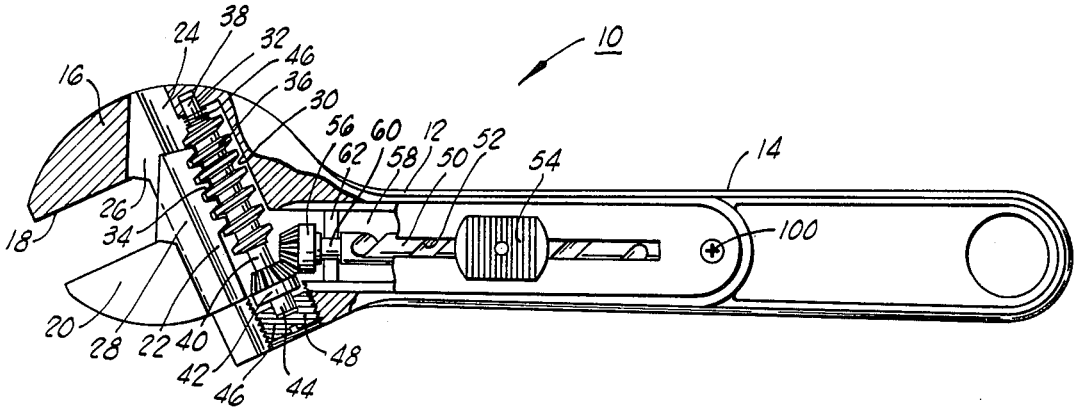
FIG. 1 is a plan view of a wrench constructed in accordance with the present invention with parts shown in cutaway.

As shown in FIG. 1, an open end, helix-actuated adjustable wrench 10 consists of a handle element 12 that is unitarily formed as handle 14 and head 16 which defines the upper bearing surface or jaw 18. A lower jaw 20 having an enlarged barrel portion 22 is then slidingly received within a mating channel 24 extending generally transversely through head 16. See also FIGS. 2 and 3. The channel 24 opens forwardly to a slot configuration defined by mating side walls 26 to allow sliding passage of a narrowed plate portion 28 which extends forward into and is unitarily formed with lower jaw 20.

A generally transverse bore 30 is formed parallel to and in communication with channel 24 and a concentric, smaller diameter counterbore 32 is formed in the upper end thereof. A plurality of gear teeth 34 are formed on the posterior vertical edge of barrel 24 for mating engagement with worm gear 36 as rotatably retained within bore 30. The worm gear 36 is unitarily formed to include a small diameter upper end or pin 38 and a lower end axle portion 40 which receives a bevel gear 42 thereon as suitably affixed above a lower axle pin 44. The worm gear 30 is then secured upwardly within bore 30 with upper pin 38 inserted in bore 32, and including a compression spring 46 therearound, whereupon a capscrew 48 is placed in threaded engagement in the lower end of bore 30 to retain the worm gear 36 in operative, rotatable position.

The helix actuating assembly consisting of helix drive rod 50 having a helical groove 52, as actuated by thumb button 54 to drive or rotate a bevel drive gear 56, is housed in handle 14 downward within an actuator cavity 58. A circumferential channel 60 is formed at the forward end of rod 50 to provide a bearing surface of engagement with a base support bearing 62 as unitarily formed in cavity 58, to be further described. And the distal or rearward end of drive rod 50 is similarly bearing supported as will be further described below. Thus, adjustment of wrench 10 is carried out by thumb pressured movement of thumb button 54 to rotate helical drive rod 50 and bevel drive gear 56 to impart further rotation to bevel gear 42 and worm gear 36 thereby providing reciprocal movement to lower jaw 20.

Figure 2:
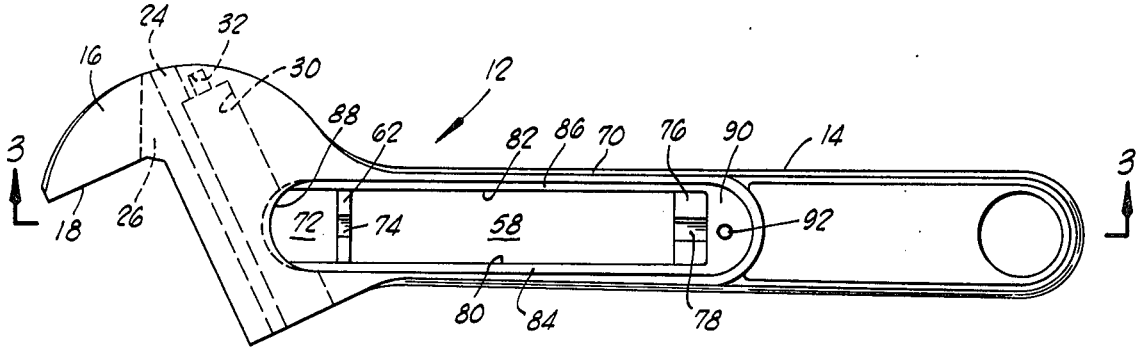
FIG. 2 is a plan view of a unitarily formed handle element of the present invention.
Figure 3:
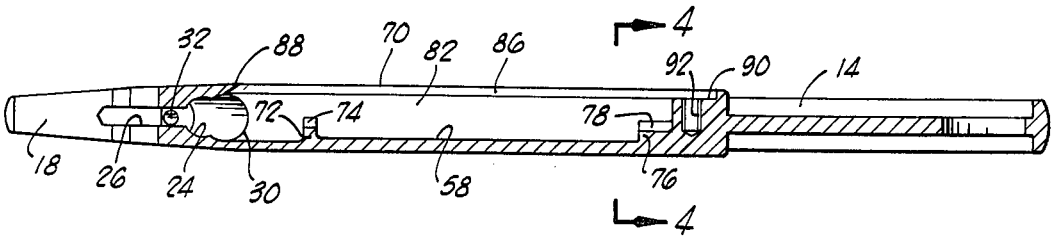
FIG. 3 is a sectional view taken along lines 3–3 of FIG. 2.
Figure 4:
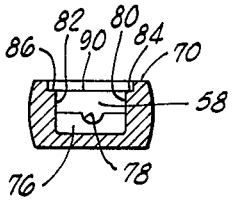
FIG. 4 is a sectional view taken along lines 4—4 of FIG. 3.

FIGS. 2 and 3 illustrate the manner in which the wrench actuator cavity 58 is formed. As depicted, cavity 58 is an elongated space of generally rectangular cross section formed downward within a forward portion 70 of handle 14. The cavity 58 is formed so that the forward end, the general area 72, is in open communication with bore 30, this providing the area through which drive bevel gear 56 engages bevel gear 42. Base bearing surfaces for rotational support of the helix drive rod 50 are unitarily formed during the initial cavity formation operation. Thus, the forward base support bearing 62 having rotational race surface 74 is formed at pre-designated position along the floor or bottom wall of cavity 58, and a rear base support bearing 76 having race surface 78 is similarly formed. Cavity side walls 80 and 82 are parallel and extend upwardly generally perpendicularly from the cavity floor to terminate in a shallow peripheral indentation constituting a cover plate seating edge 84 and 86, respectively. See also FIG. 4. The underside of forward cavity edge 88 is chamfered to provide captive retention of the front edge of the cover plate, as will be described, and a rearward seating surface 90 includes a threaded bore 92 for receiving a mating screw 100 which serves to maintain the cover plate in place.

Figure 5:
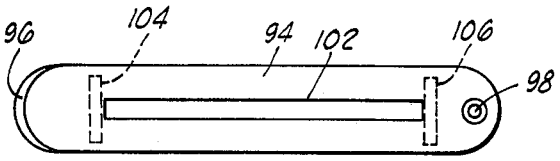
FIG. 5 is a plan view of a cover plate as utilized in the present invention.
Figure 6:
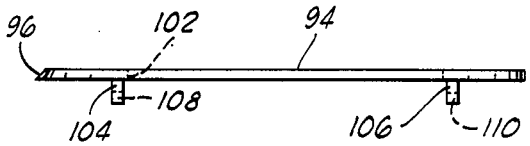
FIG. 6 is a side elevation of the cover plate of FIG. 5.
Figure 7:
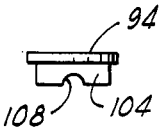
FIG. 7 is an end view elevation of the cover plate of FIG. 5.

FIGS. 5, 6 and 7 illustrate the cover plate 94, an elongated having semi-circularly rounded ends with the forward end having a downward bevel 96 for captive retention beneath chamfered edge 88, and the rearward end having a centrally located hole 98 for screw fastening in threaded bore 92 by means of screw 100 (FIG. 1). The cover plate 94 includes a central, elongated slot 102 for receiving entry of the thumb button 54 (FIG. 1), and at each end thereof there are unitarily formed retaining support bearings 104 and 106 which are placed for adaptive retaining support of helix drive rod 50 in the similar plane of operation as base support bearings 62 and 76, respectively. Thus, as shown in FIG. 6, the retaining bearings 104 and 106 each include a semi-circular bearing race surface 108 and 110, respectively.

Figure 8:
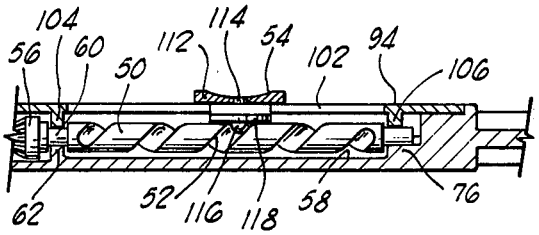
FIG. 8 is a vertical section of a portion of the wrench handle with actuator assembly installed in the actuator cavity.

The sectional view of FIG. 8 then illustrates the cavity 58, cover plate 94, thumb button 54 and helix drive rod 50 when in the assembled condition with cover plate forward bevel 96 captively retained and the rear end of cover plate 94 secured by tightening of screw 100. The thumb actuator or button 54 merely consists of a pad 112 suitably secured to a centrally and downwardly extending stub 114 which terminates in a boss 116 in engagement with helical groove 52. Stub 114 extends downward through cover plate slot 102 and is captively retained therein by a disc member 118 suitably secured to stub 114. Thus, movement of pad 112 by means of the thumb will cause movement of thumb button 54 along slot 102 while boss 116 in engagement with helical groove 52 causes rotation of helical rod 50 and the desired wrench opening or closing adjustment as aforedescribed.

The operation of the open end adjustable wrench 10 of the present invention differs none from the operation of similar wrenches which have been available heretofore; however, the principal advantages accruing to the invention lie in the particular mode of manufacture and the end results which are enabled as to costs of manufacture, ready assembly, and reliable, trouble-free usage. Of the many similar wrench designs in the past, none has enjoyed what might reasonably be termed a commercial success due to the inherent problems in manufacture, assembly and certain usage applications. Thus, with the present invention it is contemplated that many of all of the prior disadvantages are overcome finally to achieve a wrench tool of quality design for relatively economic manufacture thereby to fulfill a need in the particular area of hand tools.

The actuator cavity 54 is now one which can be formed in a single drop forging operation to also include or form the base bearings 62 and 76 therein, such base bearings being so positioned for coaction with helical rod 50 and rod end channel 60 as to maintain the helix rod 50 in proper longitudinal position to maintain beveled drive gear 56 in operative engagement with bevel gear 42 at all times. Thereafter, it is a simple operation to engage the forward end of bevel plate 94, i.e., bevel forward edge 96, then to engage thumb button 54 and boss 116, and finally to secure cover plate 94 with screw 100. Such an assembly is easily installed initially and can quite easily be taken apart and reassembled whenever cleaning is required. Further, and differing from prior similar wrench types, greater standardization of parts is possible in manufacture due to the fact that the individual components, i.e., cover plates and helix rods and the like, are readily interchangeable during initial assembly since they are coactively keyed to certain dimensional considerations of the actuator cavity thereby alleviating the problems of gear mesh and other fits attending actuator assembly installation.

Changes may be made in combination and arrangement of elements as heretofore set forth in the specification and shown in the drawings; it being understood that changes may be made in the embodiments disclosed without departing from the spirit and scope of the invention as defined in the following claims.

I claim:

1. In a helix-actuated open end adjustable wrench of the type having a handle portion which extends to form the head and upper jaw, and which includes a lower jaw movably retained in said head as driven by an adjusting worm gear and drive means for imparting rotation to said worm gear, the improvement comprising:

a unitarily formed elongated cavity in said handle portion which includes forward and rear base support bearing formations said elongated cavity being of generally square cross-sectional area formed in the forward approximately one-half of said handle portion and including said forward and rear at base support bearing formations at opposite ends thereof as transverse ribs having axially aligned semi-circular bearing surfaces in longitudinally central indentation therein;

a helical drive rod having a helical groove formed along the central extent thereof and which includes circumferential grooves at each end thereof for mating engagement within said axially aligned semi-circular bearing surfaces of said forward and rear base support bearing formations, and which helical drive rod is further connected at the forward end to impart rotation to said drive means;

a cover plate securable over said cavity and having an elongated central slot extending therealong, said cover plate including unitarily formed forward and rear retaining bearing formations which contact said helical drive rod circumferential grooves in rotational support opposite said respective forward and rear base support bearing formations; and thumb actuating means extending through said cover plate central slot to project a boss into engagement with said helical groove, whereby movement of said thumb actuating means along said elongated slot imparts rotation to said helical drive rod and drive means to rotate said adjusting worm gear.

2. Apparatus as set forth in claim 1 wherein said cover plate comprises:

a flat elongated, slotted plate having unitarily formed at opposite ends of the underside, transverse ribs having axially aligned semi-circular bearing surfaces in indentation thereon for mating rotational engagement with said helical drive rod.

3. Apparatus as set forth in claim 2 wherein the structure is further characterized in that:

said elongated cavity forward end is a semi-circularly rounded end with the forward end around the cavity opening having an inward, downward bevel, and said cover plate forward end is of similar semi-circular shape having an outward, downward bevel for mating, captive engagement beneath said cavity bevel whereupon affixure of the cover plate rear end maintains said cover plate in operational attitude.

* * * * *

UNITED STATES PATENT OFFICE

CERTIFICATE OF CORRECTION

Patent No. 4,046,034 Dated 6 September 1977

Inventor(s) Harry J. Flewelling

It is certified that error appears in the above-identified patent and that said Letters Patent are hereby corrected as shown below:

IN THE SPECIFICATION:

Column 1, line 36, cancel "measure" and substitute --measures --.

Column 1, line 62, after "helix-actuated" add -- adjustable --.

Column 2, line 56, cancel "of" (2nd occurrence) and substitute -- for --.

Column 3, line 24, after "gated" add -- plate --.
Column 3, line 67, cancel "of" (1st occurrence) and substitute -- or --.

IN THE CLAIMS:

Claim 1, Column 4, line 43, cancel "at".

Signed and Sealed this

Second Day of May 1978

[SEAL]

Attest:

RUTH C. MASON
Attesting Officer

LUTRELLE F. PARKER
Acting Commissioner of Patents and Trademarks